US011174745B2

(12) United States Patent
Inomata et al.

(10) Patent No.: US 11,174,745 B2
(45) Date of Patent: Nov. 16, 2021

(54) TURBINE STATOR BLADE

(71) Applicant: Toshiba Energy Systems & Solutions Corporation, Kawasaki (JP)

(72) Inventors: Asako Inomata, Yokohama (JP); Shinji Tanigawa, Yokohama (JP); Iwataro Sato, Hiratsuka (JP); Hideyuki Maeda, Yokohama (JP); Satoru Sekine, Yokohama (JP); Kazutaka Tsuruta, Yokohama (JP)

(73) Assignee: Toshiba Energy Systems & Solutions Corporation, Kawasaki (JP)

( * ) Notice: Subject to any disclaimer, the term of this patent is extended or adjusted under 35 U.S.C. 154(b) by 110 days.

(21) Appl. No.: 16/662,203

(22) Filed: Oct. 24, 2019

(65) Prior Publication Data

US 2020/0131923 A1 Apr. 30, 2020

(30) Foreign Application Priority Data

Oct. 26, 2018 (JP) ..... JP2018-201707

(51) Int. Cl.
*F01D 9/04* (2006.01)
*F01D 11/24* (2006.01)
*F01D 25/14* (2006.01)

(52) U.S. Cl.
CPC ..... *F01D 9/041* (2013.01); *F01D 11/24* (2013.01); *F01D 25/14* (2013.01); *F05D 2240/12* (2013.01); *F05D 2240/14* (2013.01); *F05D 2240/81* (2013.01); *F05D 2260/20* (2013.01); *F05D 2260/22141* (2013.01)

(58) Field of Classification Search
None
See application file for complete search history.

(56) References Cited

U.S. PATENT DOCUMENTS 9,512,782 B2 * 12/2016 Jackson ..... F01D 25/08
10,641,116 B2 * 5/2020 Otomo ..... F01D 9/041

FOREIGN PATENT DOCUMENTS

JP 2015-059486 A 3/2015

* cited by examiner

*Primary Examiner* — Juan G Flores
(74) *Attorney, Agent, or Firm* — Oblon, McClelland, Maier & Neustadt, L.L.P.

(57) ABSTRACT

A stator blade of an embodiment includes: a blade effective part having hollow portions; an outer shroud having an outer plate flange portion provided on a radial-direction outer side of the blade effective part, and a pair of outer mounting portions provided in a circumferential direction on a front edge side and a rear edge side; an inner shroud having an inner plate flange portion provided on a radial-direction inner side of the blade effective part; cooling medium introduction passages which introduce a cooling medium via opening portions formed in the outer plate flange portion and passing through the outer plate flange portion in a radial direction, to the hollow portions; and a cooling medium introduction passage formed in a direction along a surface of the outer plate flange portion in a wall thickness of the outer plate flange portion, which introduces a cooling medium to the hollow portion.

7 Claims, 7 Drawing Sheets

TURBINE STATOR BLADE

CROSS REFERENCE TO RELATED APPLICATIONS

This application is based upon and claims the benefit of priority from Japanese Patent Application No. 2018-201707, filed on Oct. 26, 2018; the entire contents of which are incorporated herein by reference.

FIELD

Embodiments described herein relate generally a turbine stator blade.

BACKGROUND

In response to demands for reduction of carbon dioxide, resource saving, and the like, increasing the efficiency of power generation plants is in progress. Therefore, in gas turbine power generation plants, increasing the temperature of a working fluid, and the like are actively in progress. In order to respond to this increase in the temperature of the working fluid, various attempts are made regarding cooling of stator blades, rotor blades, and the like.

In recent years, a power generation plant in which carbon dioxide produced in a combustor is circulated as a working fluid in a system is under study. Specifically, this power generation plant includes a combustor which combusts oxygen and fuel such as hydrocarbon. The carbon dioxide introduced as the working fluid to the combustor is introduced to a turbine with a combustion gas (carbon dioxide and water vapor) produced by the combustion. The turbine is driven by these introduced combustion gas and working fluid. Then, power generation is performed by a generator by utilizing the drive of the turbine.

The turbine exhaust (carbon dioxide and water vapor) exhausted from the turbine is cooled by a heat exchanger, thereby removing water to become carbon dioxide (working fluid). The carbon dioxide is pressurized by a compressor to become a supercritical fluid. Most of the pressurized carbon dioxide is heated by the above-described heat exchanger to be circulated to the combustor. In the pressurized carbon dioxide, the part corresponding to carbon dioxide produced by combustion of the fuel and oxygen supplied from the outside is recovered to be utilized for other uses, for example.

A turbine inlet pressure obtained by using the above supercritical carbon dioxide as a working fluid is about 20 times a turbine inlet pressure in a conventional gas turbine. Note that a turbine in which the supercritical carbon dioxide is used as the working fluid is referred to as a $CO_2$ turbine in the following.

Further, a temperature of the working fluid at the turbine inlet of the $CO_2$ turbine is over 1000° C., and equal to a temperature of a working fluid at a turbine inlet of a current turbine. Then, since the turbine inlet pressure is high in the $CO_2$ turbine as described above, a heat transfer coefficient on a blade surface of a stator blade or the like is increased more than that of the conventional gas turbine.

In the $CO_2$ turbine, similarly to a case of the conventional gas turbine, a cooling medium having a temperature of about 350 to 550° C. is guided to cooling flow paths provided inside the stator blade and the rotor blade to cool the stator blade and the rotor blade.

For example, the stator blade includes a blade effective part, an outer shroud provided on an outer periphery side of the blade effective part, and an inner shroud provided on an inner periphery side of the blade effective part.

In a conventional stator blade, the total amount of the cooling medium for cooling the stator blade is guided via an introduction port provided in a casing from a through hole formed in the outer shroud and passing therethrough in a radial direction into the blade effective part. Then, the cooling medium guided into the blade effective part flows through a passage in the blade effective part to cool the blade effective part. The cooling medium which has cooled the blade effective part is discharged through cooling holes formed in wall thicknesses of the outer shroud and the inner shroud of the stator blade in the directions along surfaces thereof, to the outside of the blade.

As described above, in the $CO_2$ turbine, the heat transfer coefficient on the blade surface of the stator blade or the like is increased. Thus, in order to promote the cooling of the blade, a supply amount of the cooling medium to be introduced to the blade is considered to be increased, which is not appropriate from the viewpoint of efficiency improvement of a power generating system.

Further, in the conventional stator blade, the outer shroud under a large heat load is cooled by the cooling medium after cooling the blade effective part. Therefore, in the conventional stator blade, the outer shroud has not been sufficiently cooled.

DETAILED DESCRIPTION

Hereinafter, an embodiment of the present invention will be explained with reference to the drawings.

In one embodiment, a turbine stator blade includes: a blade effective part having hollow portions inside; an outer shroud having an outer plate flange portion provided on a radial-direction outer side of the blade effective part, and a pair of outer mounting portions projecting from the outer plate flange portion to a radial-direction outer side and provided in a circumferential direction on a front edge side and a rear edge side; and an inner shroud having an inner plate flange portion provided on a radial-direction inner side of the blade effective part.

Further, this turbine stator blade includes: first cooling medium introduction passages which introduce a cooling medium via through holes formed in the outer plate flange portion and passing through the outer plate flange portion in a radial direction, to the hollow portions of the blade effective part; and a second cooling medium introduction passage formed in a direction along a surface of the outer plate flange portion in a wall thickness of the outer plate flange portion, which introduces a cooling medium to the hollow portion of the blade effective part.

Figure 1:
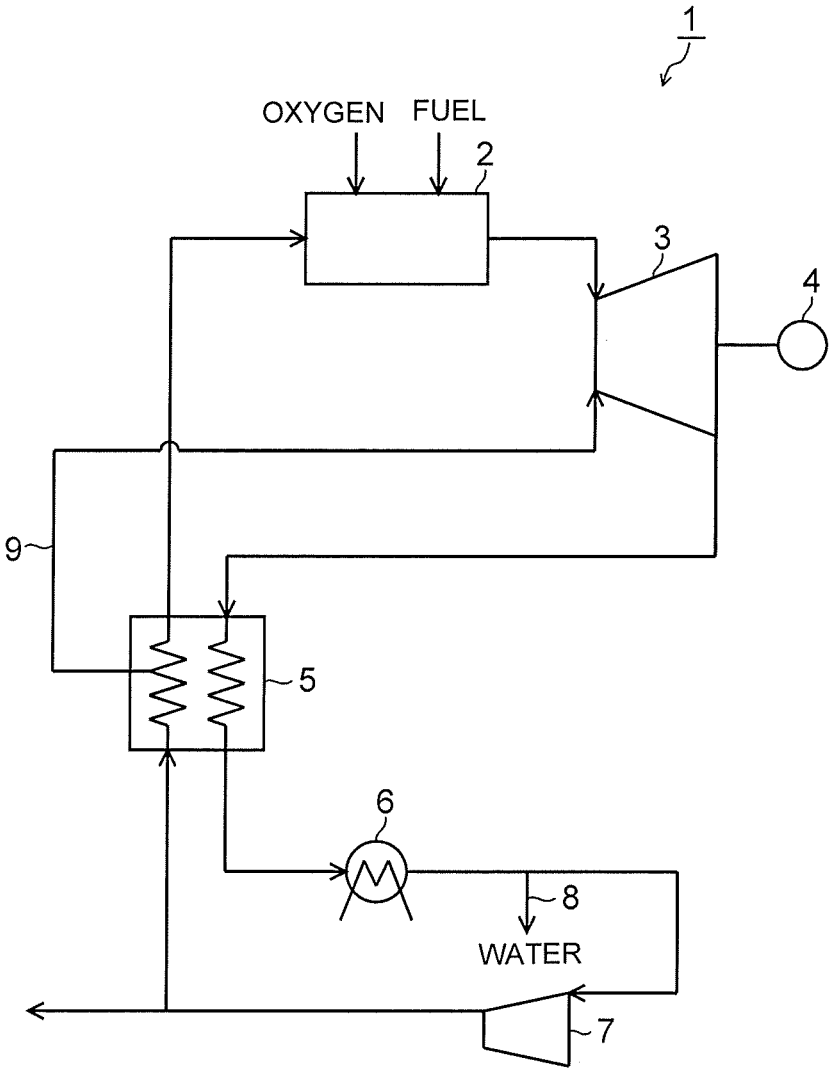
FIG. 1 is a system diagram of a gas turbine facility including a turbine provided with stator blades of an embodiment.

FIG. 1 is a system diagram of a gas turbine facility 1 including a turbine provided with stator blades of an embodiment. Note that, here, there is exemplified and explained a $CO_2$ turbine which circulates carbon dioxide produced by a combustor 2 as a working fluid.

As illustrated in FIG. 1, the gas turbine facility 1 includes a combustor 2, a turbine 3, a generator 4, a heat exchanger 5, a condenser 6, and a compressor 7.

In the gas turbine facility 1, oxygen and fuel are supplied to the combustor 2. Then, combustion occurs in the combustor 2, thereby producing carbon dioxide and water vapor. Further, the carbon dioxide circulating in the gas turbine facility 1 is introduced via the heat exchanger 5 to the combustor 2.

Flow rates of the fuel and the oxygen are regulated so as to have a stoichiometric mixture ratio (theoretical mixture ratio) in a state where they have been completely mixed with each other, for example. As the fuel, for example, there is used a hydrocarbon such as natural gas or methane, a coal gasification gas, or the like.

A combustion gas containing the carbon dioxide and the water vapor produced by the combustor 2 and the carbon dioxide introduced via the heat exchanger 5 to the combustor 2 is introduced from the combustor 2 to the turbine 3. The combustion gas introduced as the working fluid to the turbine 3 performs expansion work in the turbine 3. This causes driving of the generator 4 coupled to the turbine 3, which generates electric power.

The combustion gas discharged from the turbine 3 passes through the heat exchanger 5 to thereafter pass through the condenser 6. The water vapor contained in the combustion gas discharged from the turbine 3 is condensed into liquid water in the condenser 6. The water is discharged through a branch pipe 8 to the outside. The branch pipe 8 is branching off from a pipe through which the combustion gas which has passed through the condenser 6 flows.

The combustion gas, by separating the water vapor therefrom in the condenser 6, becomes a dry working fluid, namely carbon dioxide. This carbon dioxide is pressurized by the compressor 7 to become a supercritical fluid. At an outlet of the compressor 7, a pressure of the carbon dioxide is about 30 MPa, for example.

A part of the carbon dioxide pressurized by the compressor 7 is heated in the heat exchanger 5 and supplied to the combustor 2. The carbon dioxide introduced to the combustor 2 is ejected with the fuel and the oxidant (oxygen) from an upstream side of the combustor 2 to a combustion area (not illustrated), or ejected via dilution holes or the like to a downstream side of the combustion area after cooling a combustor liner (not illustrated), for example.

Further, a part of the carbon dioxide being the supercritical fluid is introduced as a cooling medium via a branch pipe 9 branching off halfway through a flow path in the heat exchanger 5, to the turbine 3. A temperature of this cooling medium is lower than a temperature of the combustion gas introduced to the turbine 3. The temperature of this cooling medium is preferably, for example, about 350° C. to 550° C. in consideration of a cooling effect on an object to be cooled and thermal stress to be generated in the object to be cooled.

The rest of the carbon dioxide pressurized by the compressor 7 is discharged to the outside of the system. For example, the carbon dioxide having an amount corresponding to the carbon dioxide produced by the combustion in the combustor 2 is discharged to the outside of the system.

A working gas discharged to the outside is recovered by a recovery device, for example. Further, the carbon dioxide discharged to the outside can also be utilized for EOR (Enhanced Oil Recovery) employed at an oil drilling field, for example.

Next, a constitution of the turbine 3 provided with the stator blades 30 (turbine stator blades) of the embodiment is explained.

Figure 2:
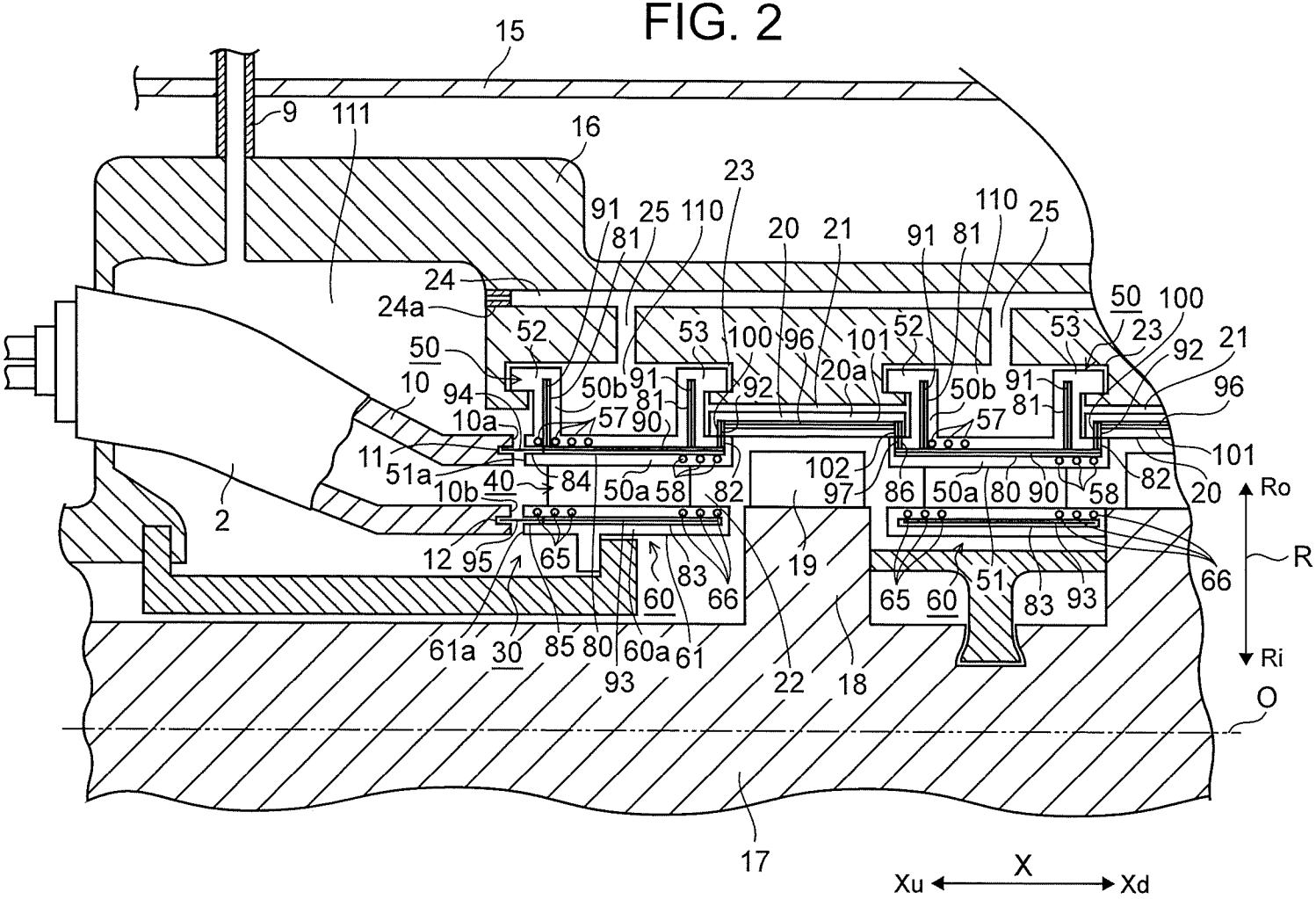
FIG. 2 is a view illustrating a part of a vertical section of the turbine provided with the stator blades of the embodiment.

FIG. 2 is a view illustrating a part of a vertical section of the turbine 3 provided with the stator blades 30 of the embodiment. The cross section illustrated in FIG. 2 illustrates a cross section between the stator blades 30 adjacent to each other in a circumferential direction.

As illustrated in FIG. 2, the turbine 3 includes a cylindrical outer casing 15 and a cylindrical inner casing 16 provided inside the outer casing 15. Inside the inner casing 16, a plurality of the stator blades 30 are disposed in the circumferential direction to constitute a stator blade cascade. Note that the stator blades 30 are supported by the inner casing 16.

Further, on an immediately downstream side of the stator blade cascade, a rotor blade cascade constituted by implanting a plurality of rotor blades 19 (turbine rotor blades) on rotor disks 18 of a turbine rotor 17 in the circumferential direction is disposed. The stator blade cascade and the rotor blade cascade are arranged alternately along a turbine rotor axial direction. The stator blade cascade and the rotor blade cascade immediately downstream from this stator blade cascade constitute one turbine stage.

Here, the turbine rotor axial direction (hereinafter, referred to as an axial direction X) is a direction in which a rotation axis O of the turbine rotor 17 extends. In the axial direction X, an upstream side of a flow of the working fluid (combustor side) is set as an upstream side Xu, and a downstream side of a flow of the working fluid (turbine outlet side) is set as a downstream side Xd. The circumferential direction is a circumferential direction centering the rotation axis O of the turbine rotor 17.

Further, a direction perpendicular to the rotation axis O is set as a radial direction R. In the radial direction R, a side approaching the rotation axis O is set as a radial-direction inner side Ri, and a side going away from the rotation axis O is set as a radial-direction outer side Ro.

An outer periphery of the rotor blade 19 is surrounded by, for example, a shroud segment 20. This shroud segment 20 prevents a heat input from the combustion gas to the inner casing 16. Moreover, the shroud segment 20 regulates a gap between a tip of the rotor blade 19 and the shroud segment 20 to maintain a proper gap. As illustrated in FIG. 2, the shroud segment 20 is supported by the stator blades 30 fixed to the inner casing 16, for example. In this case, a gap portion 21 is formed in the radial direction and the circumferential direction, between the shroud segment 20 and the inner casing 16.

Inside the inner casing 16, a circular combustion gas passage 22 is formed in a space provided with the stator blade cascade and the rotor blade cascade.

The branch pipe 9 illustrated in FIG. 1 passes through the outer casing 15 on the upstream side Xu. Then, the branch pipe 9 is coupled to the inner casing 16 on the upstream side Xu.

As illustrated in FIG. 2, in the inner casing 16, on the radial-direction outer side Ro of engaging grooves 23 locking the stator blades 30, an introduction hole 24 to which the cooling medium is guided is formed in the axial direction X.

An orifice 24*a* is provided at an end portion on the upstream side Xu of this introduction hole 24. The orifice 24*a* has an opening in the center thereof, and regulates a flow rate of the cooling medium to be introduced to the introduction hole 24.

Note that the flow rate of the cooling medium to be introduced to the introduction hole 24 is regulated by an opening diameter of the orifice 24*a*, or the like. A plurality of the introduction holes 24 each provided with this orifice 24*a* may be provided in the circumferential direction of the inner casing 16, for example.

A part of the cooling medium which has flowed from the branch pipe 9 into the inner casing 16 flows through the orifice 24*a* into the introduction hole 24.

Further, in the inner casing 16, through holes 25 are formed in the radial direction R correspondingly to positions provided with the stator blades 30. The cooling medium which has flowed into the introduction hole 24 is introduced through the through holes 25 into the stator blades 30 (blade effective parts 40).

Here, flow rates of the cooling medium to be guided to the stator blades 30 of each turbine stage are regulated by varying hole diameters of the through holes 25 formed correspondingly to the respective stator blades 30. In other words, pressures of the cooling medium to be introduced via the through holes 25 to the respective stator blades 30 are regulated by varying the hole diameters of the through holes 25 formed correspondingly to the respective stator blades 30.

Note that, here, the cooling medium introduced to one introduction hole 24 is guided via the respective through holes 25 to the respective stator blades 30, but this constitution is not restrictive.

For example, the introduction hole 24 may be provided for each of the stator blades 30 of each turbine stage. Specifically, for example, with respect to a first-stage stator blade 30 of a turbine stage, the introduction hole 24 provided with the orifice 24*a* is formed in the axial direction X in the inner casing 16. Further, with respect to a second-stage stator blade 30 of the turbine stage, the introduction hole 24 provided with the orifice 24*a* is formed in the axial direction X in the inner casing 16. These respective introduction holes 24 may be provided in plurality in the circumferential direction of the inner casing 16, for example.

Then, a part of the cooling medium which has flowed from the branch pipe 9 into the inner casing 16 flows via the orifices 24*a* into the respective introduction holes 24, and is guided via the respective through holes 25 to the respective stator blades 30. In this case, the flow rates of the cooling medium to be guided to the respective stator blades 30 are regulated by opening diameters of the orifices 24*a*, the number of introduction holes 24 to be provided in the circumferential direction, or the like.

Next, a constitution of the stator blade 30 of the embodiment is explained.

Figure 3:
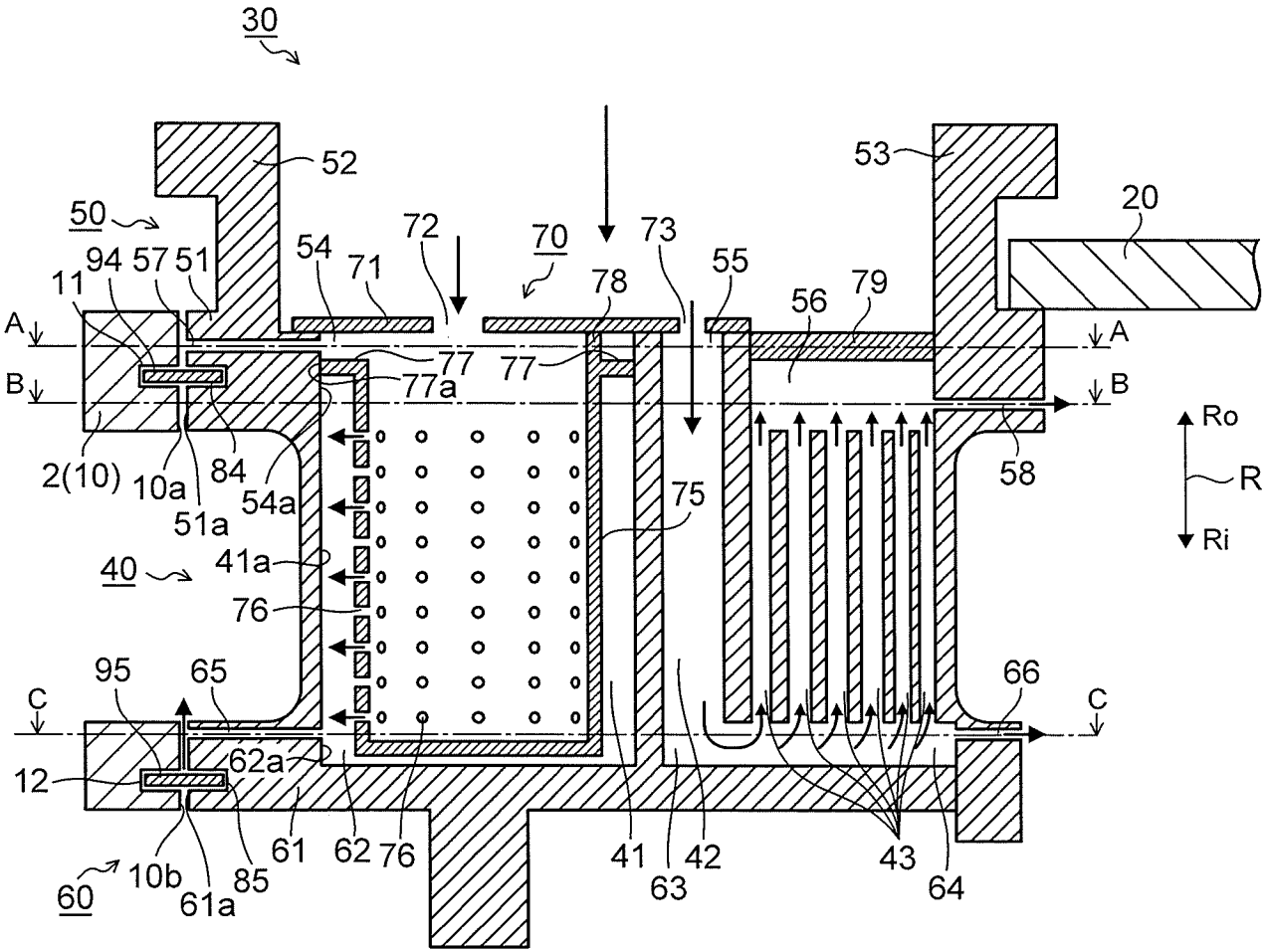
FIG. 3 is a view illustrating the vertical section of the stator blade of the embodiment.
Figure 4:
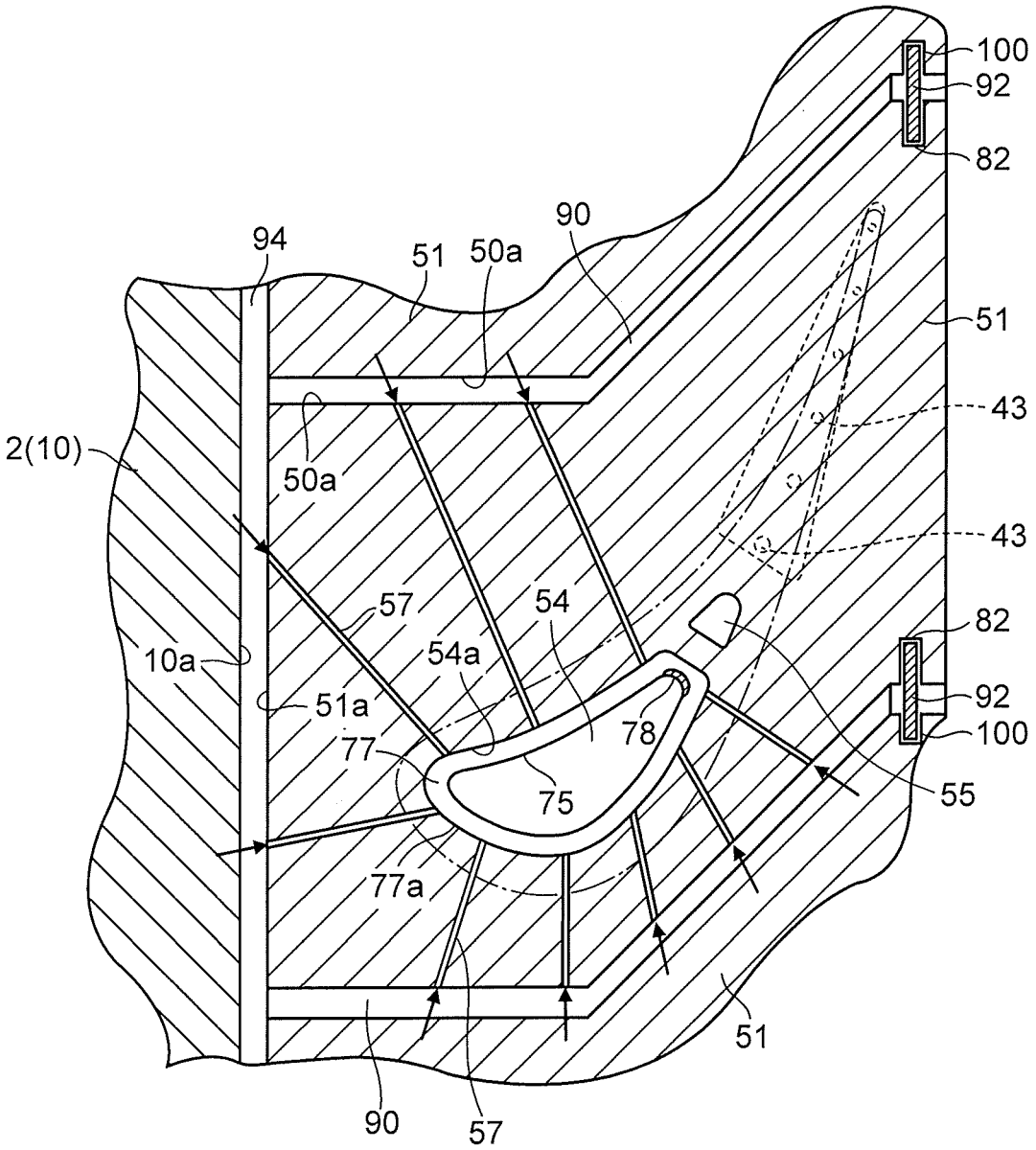
FIG. 4 is a view illustrating an A-A cross section of FIG. 3.
Figure 5:
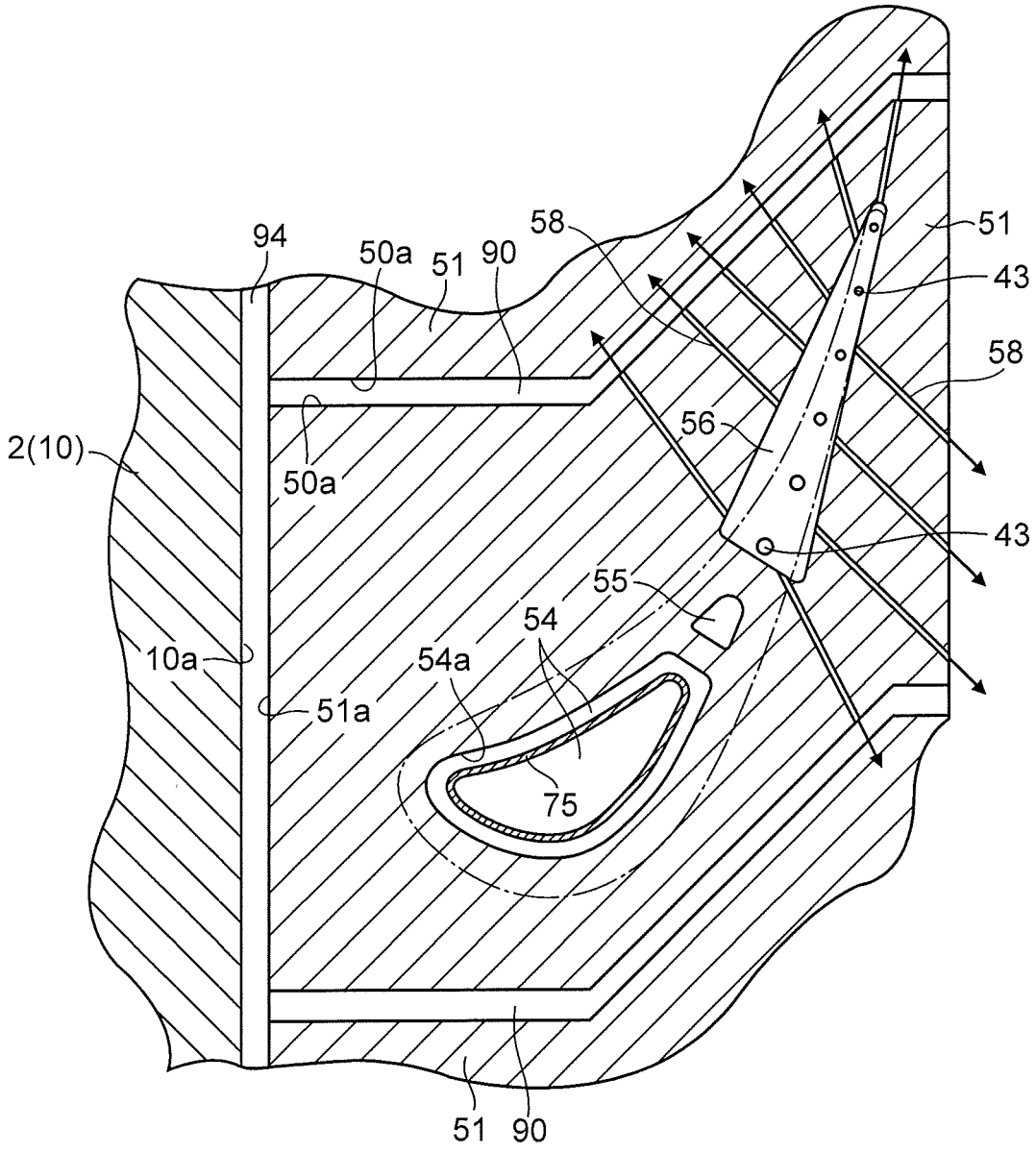
FIG. 5 is a view illustrating a B-B cross section of FIG. 3.
Figure 6:
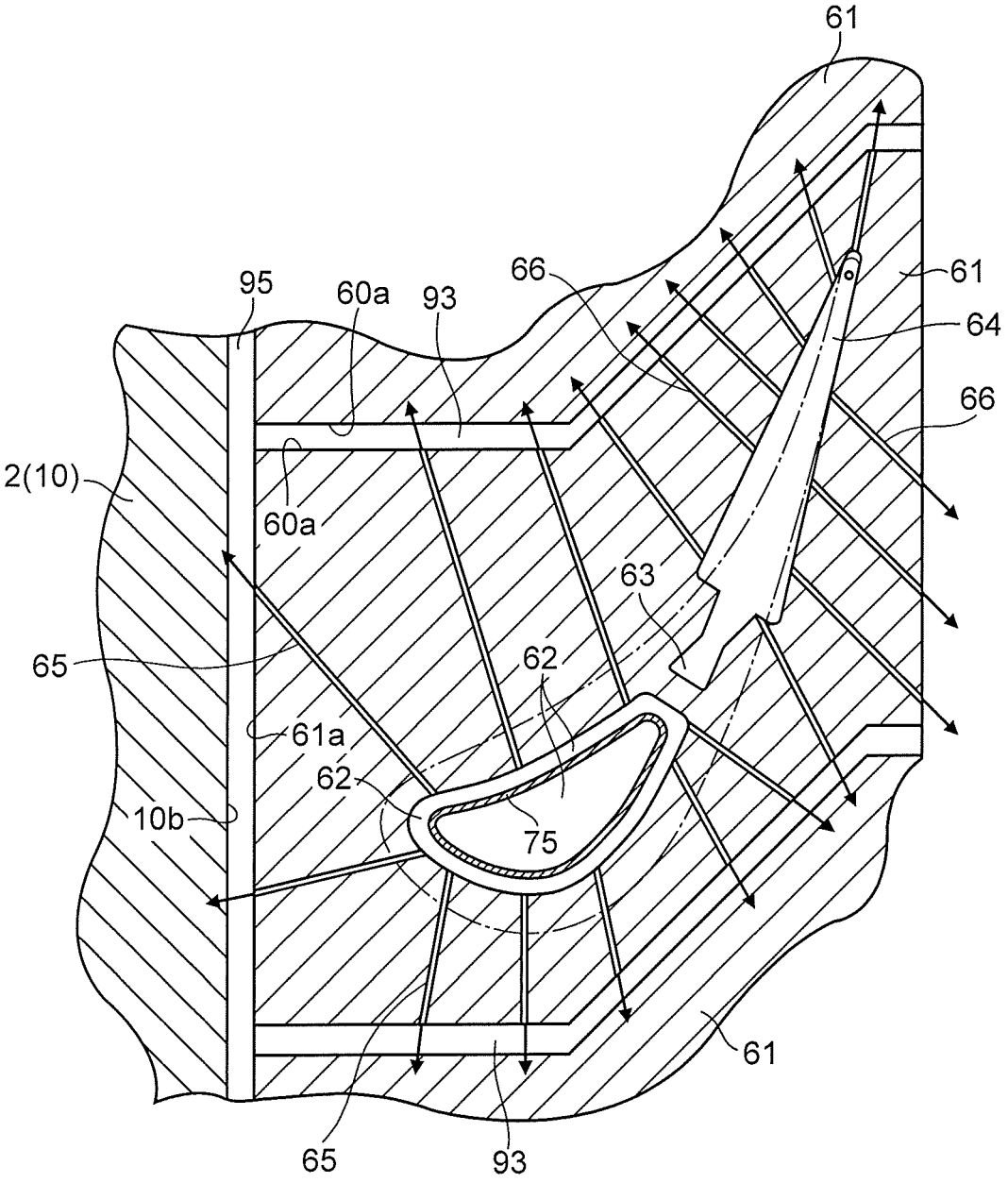
FIG. 6 is a view illustrating a C-C cross section of FIG. 3.

FIG. 3 is a view illustrating the vertical section of the stator blade 30 of the embodiment. Here, FIG. 3 is a vertical section along a camber line of the blade effective part 40. FIG. 4 is a view illustrating an A-A cross section of FIG. 3. FIG. 5 is a view illustrating a B-B cross section of FIG. 3. FIG. 6 is a view illustrating a C-C cross section of FIG. 3.

Note that, in FIG. 3 to FIG. 6, flows of the cooling medium are indicated by arrows. Further, in FIG. 4 to FIG. 6, an outline of the blade effective part 40 is indicated by a dot and dash line. Moreover, in FIG. 4 to FIG. 6, a part of the stator blade 30 adjacent in the circumferential direction is also indicated.

As illustrated in FIG. 2 and FIG. 3, the stator blade 30 includes the blade effective part 40, an outer shroud 50, and an inner shroud 60. The blade effective part 40, the outer shroud 50, and the inner shroud 60 are integrally formed, for example. The blade effective part 40 is formed in an airfoil shape in which a front edge side (for example, the left side of FIG. 3) has a curved cross-sectional shape and a rear edge side (for example, the right side of FIG. 3) has a tapered cross-sectional shape, for example.

A gap in the circumferential direction of the blade effective part 40 constitutes a part of the combustion gas passage 22. Then, the combustion gas passes around the blade effective part 40.

The radial-direction inner side Ri of the blade effective part 40 is opened. Then, an opening thereof is sealed by an inner plate flange portion 61 of the inner shroud 60. The radial-direction outer side Ro of the blade effective part 40 is opened, and provided with the outer shroud 50. Specifically, an outer plate flange portion 51 of the outer shroud 50 is provided on the radial-direction outer side Ro of the blade effective part 40.

A pair of outer mounting portions 52 and 53 projecting into the radial-direction outer side Ro are provided on the outer plate flange portion 51 of the outer shroud 50. The outer mounting portion 52 is provided in the circumferential direction on a front edge side of the stator blade 30, and the outer mounting portion 53 is provided in the circumferential direction on a rear edge side of the stator blade 30. These outer mounting portions 52 and 53 are locked in the engaging grooves 23 of the inner casing 16 illustrated in FIG. 2. This causes the stator blade 30 to be supported by the inner casing 16.

Here, in the stator blades 30 of this embodiment, between the first-stage stator blade 30 of the turbine stage and the second-stage and later stator blades 30 thereof, the constitutions on the upstream side Xu are slightly different from each other. Here, first, the first-stage stator blade 30 is explained. Then, regarding the second-stage and later stator blades 30, after a series of explanations of the first-stage stator blade 30, the constitution different from that of the first-stage stator blade 30 is mainly explained.

(Constitution of Seal Portion)

Here, seal plates are provided between the adjacent stator blades 30 provided in the circumferential direction, between the stator blade 30 and a turbine member on the upstream side Xu of the stator blade 30, and between the stator blade 30 and a turbine member on the downstream side Xd of the stator blade 30. Note that, in the sectional view illustrated in FIG. 2, the seal plates 90, 91, 92, 93, 94, 95, 96, and 97 fitted in groove portions 11, 12, 80, 81, 82, 83, 84, 85, 100, 101, and 102 are indicated with lines for convenience.

The seal plates 90, 91, 92, 93, 94, 95, 96, and 97 prevent a leakage of the combustion gas flowing through the combustion gas passage 22 to the outside of the combustion gas passage 22, and a leakage of the cooling medium introduced into the stator blade 30 to the combustion gas passage 22.

First, constitutions of the seal portions between the adjacent stator blades 30 provided in the circumferential direction are explained.

As illustrated in FIG. 2 and FIG. 3, the groove portions 80, 81, and 82 are formed on a facing side surface 50*a* and facing side surfaces 50*b* of the outer shroud 50 adjacent in the circumferential direction. The groove portions 80, 81, and 82 are each formed in a slit shape.

The groove portion 80 is formed on the side surface 50*a* of the outer plate flange portion 51. Specifically, the groove portion 80 has a predetermined groove width, and is extended in the axial direction X on the side surface 50*a* extending in the axial direction X.

The groove portions 81 are formed on the side surface 50*a* of the outer plate flange portion 51 and the side surfaces 50*b* of the outer mounting portions 52 and 53. Specifically, the groove portions 81 each have a predetermined groove width, and are extended in the radial direction R on the side surface 50*a* and the side surfaces 50*b* extending in the radial direction R (the side surfaces 50*b* of the outer mounting portions 52 and 53).

Note that the groove portion 81 formed on the upstream side Xu is extended from an upstream-side end portion of the groove portion 80 to the radial-direction outer side Ro.

The groove portion 82 is formed on the side surface 50*a* of the outer plate flange portion 51. Specifically, the groove portion 82 has a predetermined groove width, and is extended from a downstream-side end portion of the groove portion 80 to the radial-direction outer side Ro on the side surface 50*a*. As illustrated in FIG. 2, this groove portion 82 is formed so as to be joined to a groove portion 100 extended in the radial direction R on an upstream-end side of the shroud segment 20.

The seal plates 90 and 91 are fitted in the respective groove portions 80 and 81 of the outer shroud 50 adjacent in the circumferential direction respectively. Then, sealing is performed between the outer shrouds 50 adjacent in the circumferential direction.

Providing the seal plates 90 and 91 makes it possible to prevent a mixture of the combustion gas flowing through the combustion gas passage 22 and the cooling medium introduced into the stator blade 30.

Further, the seal plate 92 is fitted in the groove portion 82 of the outer shroud 50 and the groove portion 100 of the shroud segment 20 adjacent in the circumferential direction. Then, a downstream-end side of the outer shroud 50 and the upstream-end side of the shroud segment 20 adjacent to each other in the circumferential direction are sealed therebetween.

Providing the seal plate 92 prevents the combustion gas flowing through the combustion gas passage 22 from flowing into the gap portion 21 between the shroud segment 20 and the inner casing 16.

Further, the groove portion 83 is formed on a facing side surface 60*a* of the inner plate flange portion 61 of the inner shroud 60 adjacent in the circumferential direction. The groove portion 83 has a predetermined groove width, and is extended in the axial direction X on the side surface 60*a* extending in the axial direction X.

The seal plate 93 is fitted in the groove portion 83 of the inner shroud 60 adjacent in the circumferential direction. Then, sealing is performed between the inner shrouds 60 adjacent in the circumferential direction.

Providing the seal plate 93 makes it possible to prevent the combustion gas flowing through the combustion gas passage 22 from flowing out to the space between the turbine rotor 17 and the stator blade 30.

Here, the seal plates 90, 91, 92, and 93 are each composed of a plate-shaped member. The seal plate 90 fitted in the groove portion 80 formed on the side surface 50*a* extending in the axial direction X functions as a first plate-shaped member. The seal plate 93 fitted in the groove portion 83 formed on the side surface 60*a* extending in the axial direction X functions as a second plate-shaped member.

Next, constitutions of the seal portions between the stator blade 30 and the turbine member on the upstream side Xu of the stator blade 30 are explained. Note that these seal portions are provided for the first-stage stator blade 30.

Here, in a case of the first-stage stator blade 30, the turbine member on the upstream side Xu of the stator blade 30 is downstream-end members of the combustor 2 as illustrated in FIG. 2. Specifically, the turbine member is downstream-end member of a transition piece 10 of the combustor 2.

Note that the downstream-end member of the transition piece 10 of the combustor 2 functions as a first turbine member and a second turbine member.

In the case of the first-stage stator blade 30, as illustrated in FIG. 2 and FIG. 3, the groove portions 11 and 84 are formed in a downstream-side end face 10*a* of the transition piece 10 adjacent to the upstream side Xu and an upstream-side end face 51*a* of the outer plate flange portion 51 of the outer shroud 50 facing this downstream-side end face 10*a*. The groove portions 11 and 84 are each formed in a slit shape.

The groove portion 11 has a predetermined groove width, and is extended in the circumferential direction on the downstream-side end face 10*a* extending in the circumferential direction. The groove portion 84 has a predetermined groove width, and is extended in the circumferential direction on the upstream-side end face 51*a* extending in the circumferential direction.

The seal plate 94 is fitted in these respective facing groove portions 11 and 84. Then, the downstream-side end face 10*a* and the upstream-side end face 51*a* are sealed therebetween over the circumferential direction. Note that a constitution of the seal plate 94 is the same as the above-described constitutions of the other seal plates. Further, the seal plate 94 functions as a fourth plate-shaped member.

Further, in the case of the first-stage stator blade 30, as illustrated in FIG. 2 and FIG. 3, the groove portions 12 and 85 are formed on a downstream-side end face 10*b* of the transition piece 10 adjacent to the upstream side Xu and an upstream-side end face 61*a* of the inner plate flange portion 61 of the inner shroud 60 facing this downstream-side end face 10*b*. The groove portions 12 and 85 are each formed in a slit shape.

The groove portion 12 has a predetermined groove width, and is extended in the circumferential direction on the downstream-side end face 10*b* formed in the circumferential direction. The groove portion 85 has a predetermined groove width, and is extended in the circumferential direction on the upstream-side end face 61*a* formed in the circumferential direction.

The seal plate 95 is fitted in these respective facing groove portions 12 and 85. Then, the downstream-side end face 10*b* and the upstream-side end face 61*a* are sealed therebetween over the circumferential direction. Note that a constitution of the seal plate 95 is the same as the above-described constitutions of the other seal plates. Further, the seal plate 95 functions as a third plate-shaped member.

Providing the seal plates 94 and 95 makes it possible to prevent the combustion gas flowing through the combustion gas passage 22 from flowing out to the space in inner casing 16.

Next, constitutions of the seal portions between the shroud segments 20 provided in the circumferential direction are explained.

Here, in the shroud segment 20, the seal plates 96 and 97 are provided other than the above-described seal plate 92 provided in the circumferential direction and sealing between the shroud segments 20 on the upstream side Xu.

As illustrated in FIG. 2, the seal plate 96 is provided between the shroud segments 20 provided in the circumferential direction. This seal plate 96 prevents the combustion gas flowing through the combustion gas passage 22 from flowing into the gap portion 21 between the shroud segment 20 and the inner casing 16.

The groove portions 101 and 102 are also formed other than the above-described groove portion 100 on a facing side surface 20*a* of the shroud segment 20 adjacent in the circumferential direction. The groove portions 101 and 102 are each formed in a slit shape.

Specifically, the groove portion 101 has a predetermined groove width, and is extended in the axial direction X on the side surface 20*a* extending in the axial direction X. An upstream end of the groove portion 101 is joined to an end portion on the radial-direction outer side Ro of the groove portion 100.

The groove portion 102 has a predetermined groove width, and is extended in the radial direction R at a downstream-side end portion of the shroud segment 20. An end portion on the radial-direction outer side Ro of the groove portion 102 is joined to a downstream end of the groove portion 101. Note that the groove portion 102 is formed so as to be jointed to the groove portion 86 formed on the upstream side Xu of the outer plate flange portion 51 of each of the stator blades 30 in the second turbine stage and the turbine stages downstream of the second-stage.

(Constitution of Cooling Medium Introduction Passage and Cooling Medium Discharge Passage)

The outer plate flange portion 51 of the outer shroud 50 has a polygonal flat-plate shape as illustrated in FIG. 4, for example. As illustrated in FIG. 3, opening portions 54, 55, and 56 corresponding to hollow portions 41, 42, and 43 of the blade effective part 40 are formed in this outer plate flange portion 51. The opening portions 54 and 55 are formed in the same open shapes as shapes of the hollow portions 41 and 42 respectively, for example. Further, the opening portion 56 is formed so as to be opened to the entire region where a plurality of hollow portions 43 have been formed.

Note that the opening portions 54, 55, and 56 are through holes formed in the outer plate flange portion 51 and passing therethrough in the radial direction R. Further, passages which introduce the cooling medium via the opening portions 54 and 55 of the outer plate flange portion 51 to the hollow portions 41, 42, and 43 of the blade effective part 40 function as first cooling medium introduction passages.

As illustrated in FIG. 3, a cooling medium introduction passage 57 which guides the cooling medium to the opening portion 54 and the hollow portion 41 is formed in the outer plate flange portion 51. Further, a cooling medium discharge passage 58 which discharges the cooling medium in the hollow portions 43 and the opening portion 56 to the outside of the stator blade 30 is formed in the outer plate flange portion 51.

Note that the cooling medium introduction passage 57 functions as a second cooling medium introduction passage. Further, the cooling medium discharge passage 58 functions as a first cooling medium discharge passage.

As illustrated in FIG. 3, the cooling medium introduction passage 57 is formed in a direction along a surface of the outer plate flange portion 51 in a wall thickness of the outer plate flange portion 51. In other words, the cooling medium introduction passage 57 is formed by passing through the outer plate flange portion 51 in a horizontal direction in the wall thickness thereof. Note that the wall thickness of the outer plate flange portion 51 is formed between a surface on the radial-direction outer side Ro of the outer plate flange portion 51 and a surface on the radial-direction inner side Ri of the outer plate flange portion 51.

Further, as illustrated in FIG. 4, the cooling medium introduction passages 57 are provided on the front edge side of the stator blade 30. At least one cooling medium introduction passage 57 is formed, and a plurality of cooling medium introduction passages 57 may be formed as illustrated in FIG. 4.

Note that the front edge side means a front edge side further than the middle of the blade effective part 40, and the rear edge side means a rear edge side further than the middle of the blade effective part 40. As the middle of the blade effective part 40, for example, the middle of the camber line of the blade effective part 40, or the like is exemplified.

Here, as illustrated in FIG. 4, providing the seal plate 90 causes a predetermined gap to be formed between the outer plate flange portions 51 adjacent in the circumferential direction. Providing this gap makes it possible to introduce the cooling medium to the cooling medium introduction passages 57 even though inlets of the cooling medium introduction passages 57 are formed on the side surface 50*a* in the circumferential direction of the outer plate flange portion 51.

As illustrated in FIG. 2, the cooling medium introduction passages 57 are formed on the radial-direction outer side Ro further than the seal plate 90 fitted in the groove portion 80 formed on the side surface 50*a* extending in the axial direction X. Further, the cooling medium introduction passages 57 are formed on the radial-direction outer side Ro further than the seal plate 94 sealing between the downstream-side end face 10*a* of the transition piece 10 and the upstream-side end face 51*a* of the outer plate flange portion 51.

Here, as illustrated in FIG. 4, providing the seal plate 94 causes a predetermined gap to be formed between the downstream-side end face 10*a* and the upstream-side end face 51*a*. The cooling medium flows from this gap through the cooling medium introduction passages 57 into the opening portion 54. Further, the cooling medium flowing between the downstream-side end face 10*a* and the upstream-side end face 51*a* is blocked by the seal plate 94, and does not flow into the combustion gas passage 22. Moreover, by providing the seal plate 94, the combustion gas flowing through the combustion gas passage 22 does not flow out to the space in the inner casing 16.

As illustrated in FIG. 3, the cooling medium discharge passage 58 is formed in a direction along a surface of the outer plate flange portion 51 in the wall thickness of the outer plate flange portion 51. In other words, the cooling medium discharge passage 58 is formed by passing through the outer plate flange portion 51 in the horizontal direction in the wall thickness thereof.

Further, as illustrated in FIG. 5, the cooling medium discharge passages 58 are provided on the rear edge side of the stator blade 30. At least one cooling medium discharge passage 58 is formed, and a plurality of cooling medium discharge passages 58 may be formed as illustrated in FIG. 5.

Here, as illustrated in FIG. 5, providing the seal plate 90 causes a predetermined gap to be formed between the outer plate flange portions 51 adjacent in the circumferential direction. Providing this gap makes it possible to discharge the cooling medium from the cooling medium discharge passages 58 to the outside even though outlets of the cooling medium discharge passages 58 are formed on the side surface 50*a* in the circumferential direction of the outer plate flange portion 51.

Moreover, as illustrated in FIG. 3, the cooling medium discharge passage 58 is formed on the radial-direction inner side Ri further than the cooling medium introduction passage 57. Further, as illustrated in FIG. 2, the cooling medium discharge passages 58 are formed on the radial-direction inner side Ri further than the seal plate 90 fitted in the groove portion 80 formed on the side surface 50*a* extending in the axial direction X.

Further, the cooling medium discharge passages 58 are formed on the radial-direction inner side Ri further than the seal plate 92.

By providing the cooling medium discharge passages 58 on the radial-direction inner side Ri further than the seal plate 90, the cooling medium discharged from the stator blade 30 flows out into the combustion gas passage 22 without flowing into the inside of the stator blade 30 again.

Moreover, by providing the cooling medium discharge passages 58 on the radial-direction inner side Ri further than the seal plates 90 and 92, the cooling medium discharged from the stator blade 30 does not flow into the gap portion 21 between the shroud segment 20 and the inner casing 16.

The inner plate flange portion 61 of the inner shroud 60 has a polygonal flat-plate shape as illustrated in FIG. 6 similarly to the outer plate flange portion 51, for example. As illustrated in FIG. 3, recessed portions 62, 63, and 64 corresponding to the hollow portions 41, 42, and 43 of the blade effective part 40 are formed in this inner plate flange portion 61.

The recessed portions 62 and 63 are formed in the same shapes as the shapes of the hollow portions 41 and 42 respectively, for example. The recessed portion 64 is formed so as to have recesses correspondingly to the entire region where the plurality of hollow portions 43 have been formed. The recessed portion 63 and the recessed portion 64 communicate with each other in the axial direction X.

As illustrated in FIG. 3, the cooling medium discharge passage 65 which discharges the cooling medium in the hollow portion 41 and the recessed portion 62 to the outside of the stator blade 30 is formed in the inner plate flange portion 61. Moreover, the cooling medium discharge passage 66 which discharges the cooling medium in the hollow portions 43 and the recessed portion 64 to the outside of the stator blade 30 is formed in the inner plate flange portion 61. Note that the cooling medium discharge passages 65 and 66 function as second cooling medium discharge passages.

As illustrated in FIG. 3, the cooling medium discharge passages 65 and 66 are formed in a direction along a surface of the inner plate flange portion 61 in a wall thickness of the inner plate flange portion 61. In other words, the cooling medium discharge passages 65 and 66 are formed by passing through the inner plate flange portion 61 in a horizontal direction in the wall thickness thereof. Further, the cooling medium discharge passage 65 and the cooling medium discharge passage 66 are formed in the same radial direction position, for example. Note that the wall thickness of the inner plate flange portion 61 is formed between a surface on the radial-direction outer side Ro of the inner plate flange portion 61 and a surface on the radial-direction inner side Ri of the inner plate flange portion 61.

As illustrated in FIG. 6, the cooling medium discharge passages 65 are provided on the front edge side of the stator blade 30. Further, the cooling medium discharge passages 66 are provided on the rear edge side of the stator blade 30. At least one each of the cooling medium discharge passages 65 and 66 is formed, and the cooling medium discharge passages 65 and 66 may be formed in plurality as illustrated in FIG. 6.

Here, as illustrated in FIG. 6, providing the seal plate 93 causes a predetermined gap to be formed between the inner plate flange portions 61 adjacent in the circumferential direction. Providing this gap makes it possible to discharge the cooling medium from the cooling medium discharge passages 65 and 66 to the outside even though outlets of the cooling medium discharge passages 65 and 66 are formed on the side surface 60*a* in the circumferential direction of the inner plate flange portion 61.

Further, as illustrated in FIG. 6, providing the seal plate 95 causes a predetermined gap to be formed between the downstream-side end face 10*b* and the upstream-side end face 61*a* of the inner plate flange portion 61. The cooling medium discharged from the cooling medium discharge passages 65 flows out through this gap into the combustion gas passage 22.

As illustrated in FIG. 2, the cooling medium discharge passages 65 and 66 are formed on the radial-direction outer side Ro further than the seal plate 93 fitted in the groove portion 83 formed on the side surface 60*a* extending in the axial direction X. This causes the cooling medium discharged from the cooling medium discharge passages 65 and 66 to flow into the combustion gas passage 22. Note that the cooling medium discharged from the cooling medium discharge passages 65 and 66 does not flow out to the space between the turbine rotor 17 and the stator blade 30.

Further, the cooling medium discharge passages 65 are formed on the radial-direction outer side Ro further than the seal plate 95 sealing between the downstream-side end face 10*b* of the transition piece 10 and the upstream-side end face 61*a* of the inner plate flange portion 61. This causes the cooling medium discharged from the stator blade 30 to flow out into the combustion gas passage 22 without flowing out to the space in the inner casing 16.

Next, an inner constitution of the blade effective part 40 is explained.

As illustrated in FIG. 3, the hollow portions 41, 42, and 43 are formed inside the blade effective part 40. Flow paths to make the cooling medium introduced to the inside of the blade effective part 40 flow therethrough are formed in these hollow portions 41, 42, and 43. In other words, the hollow portions 41, 42, and 43 are through holes formed in the radial direction R inside the blade effective part 40.

Note that the flow paths for the cooling medium in the blade effective part 40 illustrated in FIG. 3 are one example, which is not restrictive.

The hollow portion 41 is formed on the front edge side of the blade effective part 40 as illustrated in FIG. 3, for example. A transverse sectional shape of the hollow portion 41 is not particularly limited, but, for example, may be set as a shape corresponding to an outline shape of the blade effective part 40 on the front edge side.

The hollow portion 42 is formed in the middle of the blade effective part 40, and the hollow portions 43 are formed on the rear edge side of the blade effective part 40. Transverse sectional shapes of the hollow portions 42 and 43 are not particularly limited either. Here, a semi-elliptic shape is exemplified as the transverse sectional shape of the hollow portion 42, and a circular shape is exemplified as the transverse sectional shape of each of the hollow portions 43.

In the hollow portion 43 to be formed on the rear edge side, at least one hollow portion 43 is formed. Here, one example of forming a plurality of hollow portions 43 is presented.

An insert member 70 is disposed in the hollow portion 41 and the opening portions 54 and 55 as illustrated in FIG. 3. This insert member 70 includes a plate-shaped portion 71 and a cylindrical body portion 75.

The plate-shaped portion 71 is provided on the outer plate flange portion 51 so as to cover the opening portions 54 and 55. An opening 72 communicating with the opening portion 54 and an opening 73 communicating with the opening portion 55 are formed in the plate-shaped portion 71. The plate-shaped portion 71, a part of whose outer peripheral edge is supported by the outer plate flange portion 51, is fixed in a predetermined position as illustrated in FIG. 3, for example.

The cylindrical body portion 75 is a cylindrical body in which the radial-direction outer side Ro is opened and the radial-direction inner side Ri is closed. Flange portions 77 extending in the axial direction X are provided around an opening on the radial-direction outer side Ro of the cylindrical body portion 75. An outer peripheral side surface 77*a* of the flange portion 77 is brought into contact with an inner wall 54*a* of the opening portion 54.

Further, a support plate 78 extending from a part of the flange portion 77 to the radial-direction outer side Ro is fixed to the plate-shaped portion 71. This causes the cylindrical body portion 75 to be supported by the plate-shaped portion 71. Further, in a section of the cylindrical body portion 75 facing the inner wall 41*a* of the hollow portion 41 (a side wall of the cylindrical body portion 75), a plurality of ejection holes 76 are formed.

Here, in the stator blade 30 of the first turbine stage illustrated in FIG. 3, one example in which the ejection hole 76 is not provided in a bottom wall of the cylindrical body portion 75 is presented, but a plurality of ejection holes 76 may be provided in the bottom wall. Further, in each of the stator blades 30 in the second turbine stage and the turbine stages downstream of the second turbine stage, ejection holes 76 are provided also in a bottom wall of a cylindrical body portion 75 though not illustrated.

The cylindrical body portion 75 is inserted in the opening portion 54 and the hollow portion 41 with a predetermined gap apart from the inner wall 54*a* of the opening portion 54 and the inner wall 41*a* of the hollow portion 41. Then, the inner space of the cylindrical body portion 75 and the space between the cylindrical body portion 75 and the inner wall 54*a* and the inner wall 41*a* are divided by the flange portion 77.

Further, the cooling medium introduction passage 57 formed in the outer plate flange portion 51 is located on the radial-direction outer side Ro further than the flange portion 77. In other words, an outlet of the cooling medium introduction passage 57 is located on the radial-direction outer side Ro further than the flange portion 77.

By providing the flange portion 77, the cooling medium introduced from the cooling medium introduction passage 57 into the opening portion 54 is first guided to the inside of the cylindrical body portion 75.

Further, the cooling medium discharge passage 65 formed in the inner plate flange portion 61 communicates with the space between the cylindrical body portion 75 and the inner wall 62*a* of the recessed portion 62. This causes the cooling medium ejected from the ejection holes 76 of the cylindrical body portion 75 toward the inner wall 41*a* of the hollow portion 41 to be discharged through the cooling medium discharge passage 65 to the outside.

The opening portion 56 opened to the entire region where the plurality of hollow portions 43 have been formed is blocked by a flat plate 79.

As illustrated in FIG. 3, the cooling medium discharge passage 58 formed in the outer plate flange portion 51 communicates with the opening portion 56. Further, the cooling medium discharge passage 66 formed in the inner plate flange portion 61 communicates with the recessed portion 64. Thus, the cooling medium in the opening portion 56 is discharged through the cooling medium discharge passage 58 to the outside. The cooling medium in the recessed portion 64 is discharged through the cooling medium discharge passage 66 to the outside.

Next, flows of the cooling medium in the stator blade 30 of the embodiment are explained with reference to FIG. 2 to FIG. 6.

Note that, as the cooling medium, for example, as described above, the carbon dioxide being the supercritical fluid extracted from halfway through the flow path in the heat exchanger 5 is used (refer to FIG. 1).

The cooling medium which has branched off halfway through the flow path in the heat exchanger 5 is introduced via the branch pipe 9 into the inner casing 16, as illustrated in FIG. 2. A part of the cooling medium introduced into the inner casing 16 flows through the orifice 24*a* into the introduction hole 24.

The cooling medium which has flowed into the introduction hole 24 flows through the through holes 25 of the inner casing 16 to the stator blade 30 sides. The cooling medium flowing through the through holes 25 to the stator blade 30 sides flows in annular spaces 110 each surrounded by the outer mounting portions 52 and 53, the outer plate flange portion 51, the inner casing 16, and the seal plates 90 and 91.

As illustrated in FIG. 3, a part of the cooling medium which has flowed into the space 110 flows through the openings 72 and 73 of the plate-shaped portion 71 passing therethrough in the radial direction R, into the blade effective part 40. Specifically, the cooling medium which has passed through the opening 72 of the plate-shaped portion 71 flows into the cylindrical body portion 75. The cooling medium which has passed through the opening 73 of the plate-shaped portion 71 flows into the hollow portion 42.

The remainder of the cooling medium which has flowed into the space 110 flows through the cooling medium introduction passages 57 whose inlets are opened to the space 110, into the opening portion 54, as illustrated in FIG. 2, FIG. 3, and FIG. 4. The cooling medium which has flowed into the opening portion 54 flows into the cylindrical body portion 75.

Meanwhile, the remainder of the cooling medium introduced into the inner casing 16 flows from the gap between the downstream-side end face 10*a* of the transition piece 10 and the upstream-side end face 51*a* of the outer plate flange portion 51 through the cooling medium introduction passages 57 into the opening portion 54. Note that the inlets of these cooling medium introduction passages 57 are opened to the space 111 in the inner casing 16 in which the annular combustor 2 is provided. Therefore, the cooling medium is introduced directly from the space 111 to these cooling medium introduction passages 57. The cooling medium which has flowed into the opening portion 54 flows into the cylindrical body portion 75.

Here, as described above, among the cooling medium introduction passages 57 provided in plurality, the ones to which the cooling medium is introduced from the space 111 and the ones to which the cooling medium is introduced from the space 110 are present.

Then, when the cooling medium passes through the cooling medium introduction passages 57, the outer plate flange portion 51 is cooled.

Here, a flow rate of the cooling medium introduced via the branch pipe 9 into the inner casing 16 is the same as a flow rate of a cooling medium for cooling a conventional stator blade. Then, in this embodiment, the cooling medium flows separately into the cooling medium introduction passages which introduce the cooling medium from the radial direction R, and the cooling medium introduction passages 57 formed along the surface of the outer plate flange portion 51 in the wall thickness of the outer plate flange portion 51. That is, a total of a flow rate of the cooling medium flowing from the cooling medium introduction passages which introduce the cooling medium from the radial direction R, into the blade effective part 40, and a flow rate of the cooling medium flowing from the cooling medium introduction passages 57 into the blade effective part 40 is the same as the flow rate of the cooling medium for cooling the conventional stator blade.

The cooling medium which has flowed into the cylindrical body portion 75 is ejected from the ejection holes 76 toward the inner wall 41*a* of the hollow portion 41 to collide with the inner wall 41*a*, as illustrated in FIG. 3. Making the cooling medium collide with the inner wall 41*a* promotes heat transfer between the inner wall 41*a* and the cooling medium, which efficiently cools the blade effective part 40.

The cooling medium which has collided with the inner wall 41*a* flows out through the cooling medium discharge passage 65 of the inner plate flange portion 61, and a gap between the downstream-side end face 10*b* of the transition piece 10 and the upstream-side end face 61*a* of the inner plate flange portion 61, into the combustion gas passage 22.

When the cooling medium passes through the cooling medium discharge passages 65, the inner plate flange portion 61 is cooled.

The cooling medium which has flowed out into the combustion gas passage 22 flows to the downstream side Xd with the combustion gas flowing through the combustion gas passage 22.

Meanwhile, the cooling medium which has flowed into the opening portion 55 of the outer plate flange portion 51 and the hollow portion 42 of the blade effective part 40 flows to the radial-direction inner side Ri while cooling a wall surface forming the hollow portion 42. Then, the cooling medium flows through the recessed portions 63 and 64 of the inner plate flange portion 61, into the hollow portions 43 of the blade effective part 40.

A part of the cooling medium flowing through the recessed portions 63 and 64 of the inner plate flange portion 61 flows out through the cooling medium discharge passage 66 of the inner plate flange portion 61 into the combustion gas passage 22. When the cooling medium passes through the cooling medium discharge passages 66, the inner plate flange portion 61 is cooled.

The cooling medium flowing through the hollow portions 43 of the blade effective part 40 to the radial-direction outer side Ro flows into the opening portion 56. The cooling medium which has flowed into the opening portion 56 flows out through the cooling medium discharge passage 58 of the outer plate flange portion 51 into the combustion gas passage 22. When the cooling medium passes through the cooling medium discharge passages 58, the outer plate flange portion 51 is cooled.

(Constitution of the Stator Blades in the Second Turbine Stage and the Turbine Stages Downstream of the Second Turbine Stage)

Here, regarding the stator blades 30 in the second turbine stage and the turbine stages downstream of the second turbine stage, a constituent part different from that of the constitution of the stator blade 30 in the first turbine stage is explained.

As illustrated in FIG. 2, the stator blades 30 in the second turbine stage and the turbine stages downstream of the second turbine stage each have a constitution of a seal portion in the circumferential direction on the upstream side Xu of an outer plate flange portion 51 of an outer shroud 50 different from the constitution of the seal portion in the circumferential direction on the upstream side Xu of the outer plate flange portion 51 in the stator blade 30 in the first turbine stage. Here, this different constitution is mainly explained.

Note that constitutions of the other seal portions in each of the stator blades 30 in the second turbine stage and the turbine stages downstream of the second turbine stage are the same as the constitutions of the seal portions in the stator blade 30 in the first turbine stage.

Figure 7:
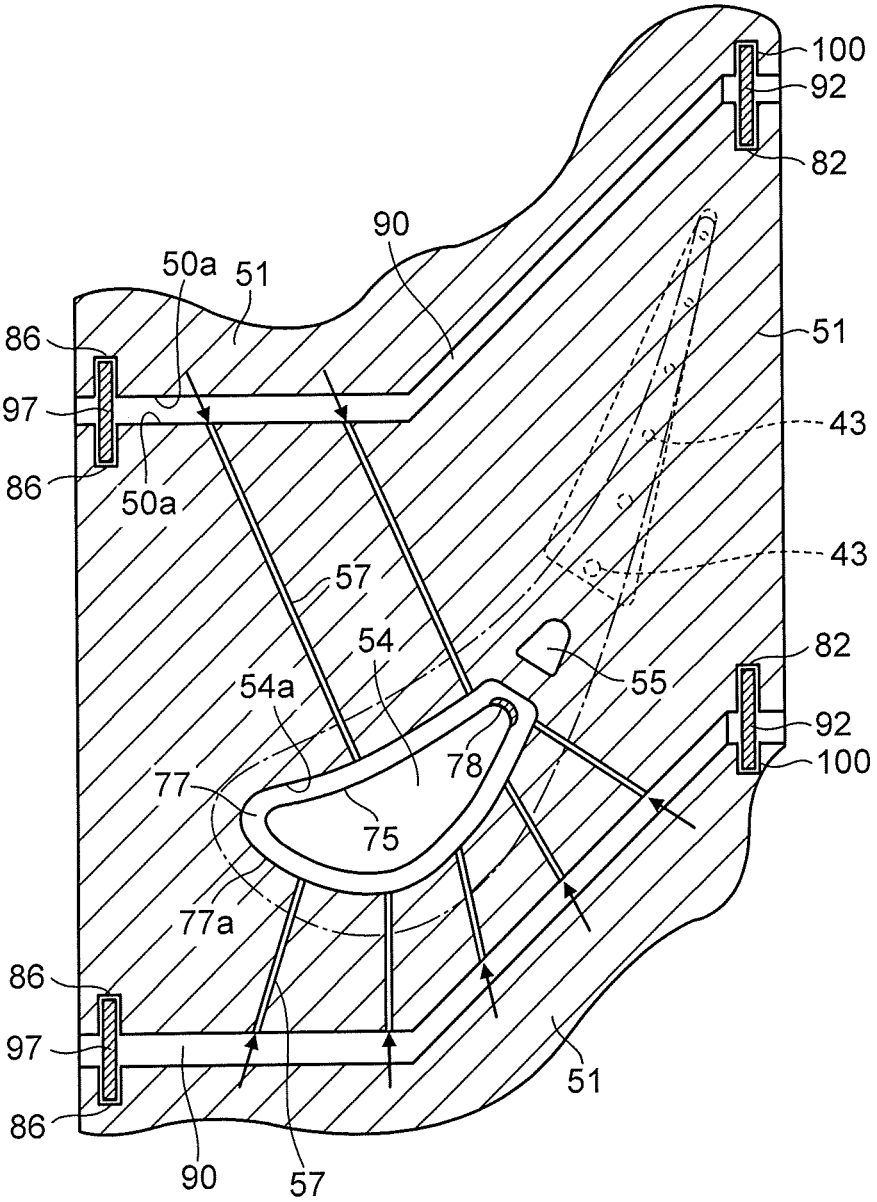
FIG. 7 is a view illustrating a part of a cross section corresponding to the A-A cross section of FIG. 3 regarding each of second-stage and later stator blades in a turbine stage in the embodiment.

FIG. 7 is a view illustrating a part of a cross section corresponding to the A-A cross section of FIG. 3 regarding each of the stator blades 30 in the second turbine stage and the turbine stages downstream of the second turbine stage in the embodiment. Note that, here, the stator blade 30 in the second turbine stage illustrated in FIG. 2 and FIG. 7 are mainly referred. Further, in FIG. 7, the same constituent parts as those of the constitution of the stator blade 30 in the first turbine stage are denoted by the same reference signs, and redundant explanations are omitted or simplified.

In each of the stator blades 30 in the second turbine stage and the turbine stages downstream of the second turbine stage, as illustrated in FIG. 2 and FIG. 7, at an upstream-side end portion on a side surface 50*a* in the circumferential direction of the outer plate flange portion 51, a groove portion 86 having a predetermined groove width is extended in the radial direction R. As illustrated in FIG. 2, an end portion on the radial-direction inner side Ri of the groove portion 86 is joined to an upstream end of a groove portion 80 formed on the side surface 50*a* of the outer plate flange portion 51.

Note that, as described above, the groove portion 86 is formed so as to be joined to the groove portion 102 extended in the radial direction R on the downstream-end side of the shroud segment 20. Then, the seal plate 97 is fitted in the groove portion 86 and the groove portion 102.

Providing the seal plates 92, 96, and 97 prevents the combustion gas flowing through the combustion gas passage 22 from flowing into the gap portion 21 between the shroud segment 20 and the inner casing 16.

Thus, the stator blades 30 in the second turbine stage and the turbine stages downstream of the second turbine stage are each provided with the seal portions sealing between the stator blades 30 in the circumferential direction, on the upstream side Xu of the outer shroud 50 and the inner shroud 60. On the other hand, the stator blades 30 in the second turbine stage and the turbine stages downstream of the second turbine stage are not each provided with the seal member sealing between the outer shroud 50 and the turbine member adjacent to the upstream side Xu of the outer shroud 50, and the seal member sealing between the inner shroud 60 and the turbine member adjacent to the upstream side Xu of the inner shroud 60.

The stator blade 30 sides of the through holes 25 of the inner casing 16 have the annular spaces 110 each surrounded by the outer mounting portions 52 and 53, the outer plate flange portion 51, the inner casing 16, and the seal plates 90 and 91.

Here, the cooling medium which has flowed into the introduction hole 24 of the inner casing 16 flows through the through holes 25 to the stator blade 30 sides. The cooling medium flowing through the through holes 25 to the stator blade 30 sides flows into the annular spaces 110.

A part of the cooling medium which has flowed into the space 110 flows through openings 72 and 73 of a plate-shaped portion 71 passing therethrough in the radial direction R, into a blade effective part 40. Specifically, the cooling medium which has passed through the opening 72 of the plate-shaped portion 71 flows into a cylindrical body portion 75. The cooling medium which has passed through the opening 73 of the plate-shaped portion 71 flows into a hollow portion 42.

The remainder of the cooling medium which has flowed into the space 110 flows through cooling medium introduction passages 57 whose inlets are opened to the space 110, into an opening portion 54. The cooling medium which has flowed into the opening portion 54 flows into a cylindrical body portion 75.

Here, in the stator blades 30 in the second turbine stage and the turbine stages downstream of the second turbine stage, the inlets of all the cooling medium introduction passages 57 are opened to the spaces 110.

Note that a flow of the cooling medium is similar to the above-described flow of the cooling medium in the stator blade 30 in the first turbine stage.

As described above, according to the stator blade 30 of the embodiment, it is possible to introduce the cooling medium via the cooling medium introduction passages 57 formed in the outer plate flange portion 51 into the blade effective part 40 other than the cooling medium introduction passages which introduce the cooling medium via the openings 72 and 73 of the plate-shaped portion 71 passing therethrough in the radial direction R into the blade effective part 40.

The cooling medium which has flowed from the branch pipe 9 into the inner casing 16 flows into the cooling medium introduction passages 57. That is, a temperature of the cooling medium flowing through the cooling medium introduction passages 57 is lower than temperatures of the cooling medium flowing through the cooling medium discharge passages 58, 65, and 66. Therefore, the cooling of the outer plate flange portion 51 can be promoted.

Here, in the stator blade 30, a region on the upstream side Xu is exposed to a higher temperature combustion gas than a region on the downstream side Xd. Thus, providing the cooling medium introduction passages 57 on the front edge side of the stator blade 30 makes it possible to actively cool the upstream side Xu of the stator blade 30 brought in contact with the high-temperature combustion gas.

Further, introducing the cooling medium via the cooling medium introduction passages 57 into the blade effective part 40 makes it possible to cool the stator blade 30 more effectively than a conventional rotor blade even though the flow rate of the cooling medium is the same as the flow rate of the cooling medium introduced to the conventional stator blade.

Moreover, using the cooling medium which has cooled the blade effective part 40 for cooling of the outer shroud 50 and the inner shroud 60 makes it possible to utilize cooling capacity of the cooling medium to the maximum while suppressing the flow rate of the cooling medium. This also allows the stator blade 30 to be efficiently cooled.

Here, the constitutions of the stator blades 30 of the embodiment are not limited to the above-described constitutions. On blade surfaces of the stator blades 30 exposed to the combustion gas (working fluid) flowing through the combustion gas passage 22, for example, a thermal barrier coating (TBC) may be performed.

A thermal barrier coating layer is constituted of, for example, a metal bonding layer excellent in environmental resistance and a ceramic top layer having a low thermal conductivity. Note that the constitution of the thermal barrier coating layer is not particularly limited, and a commonly used constitution can be applied according to the use environment.

Providing the thermal barrier coating layer as described above makes it possible to reduce a heat input amount from the combustion gas and reduce the flow rate of the cooling medium.

Note that, here, the $CO_2$ turbine is exemplified to be explained, but the constitution of this embodiment can also be applied to other gas turbines.

According to the above-explained embodiment, it becomes possible to promote the cooling of the blades without increasing a supply amount of the cooling medium.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions.

What is claimed is:

1. A stator blade cascade comprising:

a plurality of turbine stator blades disposed in a circumferential direction, wherein each of the plurality of turbine stator blades comprises:

a blade effective part including hollow portions inside;

an outer shroud including an outer plate flange portion provided on a radial-direction outer side of the blade effective part, and a pair of outer mounting portions projecting from the outer plate flange portion to a radial-direction outer side and provided in a circumferential direction on a front edge side and a rear edge side;

an inner shroud including an inner plate flange portion provided on a radial-direction inner side of the blade effective part;

first cooling medium introduction passages which introduce a first cooling medium via through holes formed in the outer plate flange portion and passing through the outer plate flange portion in a radial direction, to the hollow portions of the blade effective part; and a second cooling medium introduction passage formed in a direction along a first surface of the outer plate flange portion in a first wall thickness of the outer plate flange portion, which introduces a second cooling medium to the hollow portions of the blade effective part, wherein the stator blade cascade includes a first turbine stator blade of the plurality of turbine stator blades including a first outer shroud and a second turbine stator blade of the plurality of turbine stator blades including a second outer shroud, the second turbine stator blade disposed circumferentially adjacent to the first turbine stator blade, the first outer shroud including a first side surface, the second outer shroud including a second side surface facing to the first side surface, the first and second side surfaces extending in a turbine rotor axial direction of the first and second outer shrouds, wherein a first plate-shaped member is provided between the first side surface and the second side surface, the first plate-shaped member sealing a gap between the first and second outer shrouds, and wherein the second cooling medium introduction passage is formed on a radial-direction outer side further than the first plate-shaped member.

2. The stator blade cascade according to claim 1, comprising a first cooling medium discharge passage formed in a direction along a second surface of the outer plate flange portion in a second wall thickness of the outer plate flange portion, which discharges a third cooling medium in the hollow portions to an outside, wherein the first cooling medium discharge passage is formed on a radial-direction inner side further than the first plate-shaped member.

3. The stator blade cascade according to claim 2, wherein the first cooling medium discharge passage is provided on a rear edge side of each of the plurality of turbine stator blades.

4. The stator blade cascade according to claim 1, wherein the first turbine stator blade includes a first inner shroud and the second turbine stator blade includes a second inner shroud, the first inner shroud including a third side surface, the second inner shroud including a fourth side surface facing to the third side surface, the third and fourth side surfaces extending in a turbine rotor axial direction of the first and second inner shrouds, wherein a second plate-shaped member is provided between the third side surface and the fourth side surface, and the second plate-shaped member sealing a gap between the first and second inner shrouds; and wherein second cooling medium discharge passages are formed in a direction along a third surface of the inner plate flange portion in a third wall thickness of the inner plate flange portion, which discharge a fourth cooling medium in the hollow portions to an outside, and wherein the second cooling medium discharge passages are formed on a radial-direction outer side further than the second plate-shaped member.

5. The stator blade cascade according to claim 1, wherein second cooling medium discharge passages are formed in a direction along a third surface of the inner plate flange portion in a third wall thickness of the inner plate flange portion, which discharge a fourth cooling medium in the hollow portions to an outside, wherein the inner shroud is an inner shroud in a stator blade of the plurality of turbine stator blades in a first turbine stage, the inner shroud comprises a third plate-shaped member sealing between the inner shroud and a first turbine member adjacent to an upstream side of the inner shroud, and wherein the second cooling medium discharge passages are formed on a radial-direction outer side further than the third plate-shaped member.

6. The stator blade cascade according to claim 1, wherein the second cooling medium introduction passage is provided on a front edge side of each of the plurality of turbine stator blades.

7. A stator blade cascade comprising:

a plurality of turbine stator blades disposed in a circumferential direction, wherein each of the plurality of turbine stator blades comprises:

a blade effective part including hollow portions inside;

an outer shroud including an outer plate flange portion provided on a radial-direction outer side of the blade effective part, and a pair of outer mounting portions projecting from the outer plate flange portion to a radial-direction outer side and provided in a circumferential direction on a front edge side and a rear edge side;

an inner shroud including an inner plate flange portion provided on a radial-direction inner side of the blade effective part;

first cooling medium introduction passages which introduce a first cooling medium via through holes formed in the outer plate flange portion and passing through the outer plate flange portion in a radial direction, to the hollow portions of the blade effective part, and a second cooling medium introduction passage formed in a direction along a surface of the outer plate flange portion in a wall thickness of the outer plate flange portion, which introduces a second cooling medium to the hollow portions of the blade effective part, wherein the outer shroud is an outer shroud in a stator blade of the plurality of turbine stator blades in a first turbine stage, the outer shroud comprises a fourth plate-shaped member sealing between the outer shroud and a second turbine member adjacent to an upstream side of the outer shroud, and wherein the second cooling medium introduction passage is formed on a radial-direction outer side further than the fourth plate-shaped member.

* * * * *